US006459965B1

(12) United States Patent
Polivka et al.

(10) Patent No.: US 6,459,965 B1
(45) Date of Patent: Oct. 1, 2002

(54) METHOD FOR ADVANCED COMMUNICATION-BASED VEHICLE CONTROL

(75) Inventors: Alan L. Polivka, Palm Bay, FL (US); James R. Egnot, Melbourne, FL (US); Robert E. Heggestad, Odessa, MO (US); Jeffrey K. Baker, Olathe, KS (US); William L. Matheson, Palm Bay, FL (US)

(73) Assignee: GE-Harris Railway Electronics, LLC, Melbourne, FL (US)

( * ) Notice: Subject to any disclaimer, the term of this patent is extended or adjusted under 35 U.S.C. 154(b) by 0 days.

(21) Appl. No.: 09/681,853

(22) Filed: Jun. 18, 2001

Related U.S. Application Data

(60) Provisional application No. 60/268,352, filed on Feb. 13, 2001.

(51) Int. Cl.[7] ..... G06F 7/00

(52) U.S. Cl. ..... 701/19; 701/20; 701/24; 180/168

(58) Field of Search ..... 180/167, 168, 180/169; 701/19, 20, 23, 24, 25, 26, 28; 318/587

(56) References Cited

U.S. PATENT DOCUMENTS

| | | | | |
|---|---|---|---|---|
| 4,711,418 A | | 12/1987 | Aver, Jr. et al. | |
| 5,364,047 A | | 11/1994 | Petit et al. | |
| 5,398,894 A | | 3/1995 | Pascoe | |
| 5,533,695 A | | 7/1996 | Heggestad et al. | |
| 5,828,979 A | | 10/1998 | Polivka et al. | |
| 5,928,294 A | * | 7/1999 | Zelinkovsky | 701/24 |
| 6,049,745 A | * | 4/2000 | Douglas et al. | 701/23 |

* cited by examiner

*Primary Examiner*—Yonel Beaulieu
(74) *Attorney, Agent, or Firm*—Carl A. Rowold; Armstrong Teasdale LLP

(57) ABSTRACT

A method is provided for controlling movement of a plurality of vehicles over a guideway partitioned into a plurality of guideway blocks. The method uses a control system including an onboard computer (OBC) located on board each vehicle, at least one server for communicating with the OBCs, and a vehicle tracking system. The method including the steps of determining a composite block status for all guideway blocks, broadcasting the composite block status to the OBCs, and controlling movement of each vehicle based on the composite block status.

76 Claims, 2 Drawing Sheets

METHOD FOR ADVANCED COMMUNICATION-BASED VEHICLE CONTROL

CROSS REFERENCE TO RELATED APPLICATIONS

This application claims the benefit of U.S. Provisional Application No. 60/268,352, filed Feb. 13, 2001, which is hereby incorporated by reference in its entirety.

BACKGROUND OF INVENTION

This invention relates generally to train movement, and more particularly to controlling the movement of a plurality of trains over a predetermined track layout.

Traditional rail traffic signal systems use an extensive array of wayside equipment to control railway traffic and maintain safe train separation. In these traditional systems railway control is achieved by detecting the presence of a train, determining a route availability for each train, conveying the route availability to a train's crew, and controlling the movement of the train in accordance with the route availability.

The presence of a train is typically detected directly through a sensor device, or track circuit, associated with a specific section of the rails, referred to as a block. The presence of a train causes a short in a block's track circuit. In this manner, the occupancy of each block is determined. Vital decision logic is employed, utilizing the block occupancy information in conjunction with other information provided, such as track switch positions, to determine a clear route availability for trains. The route availability information is then conveyed to a train crew through physical signals installed along the wayside whereupon a train crew encounters the signal and visually interprets the meaning of the displayed aspect. Alternatively, the route availability information is conveyed to train crews by passing information from the wayside to the train through the rails, referred to as continuous cab signaling, or through transponders, referred to as intermittent cab signaling, so that aspect information can be directly displayed in the cab. The train movement is then controlled by crew actions based on displayed aspect information and, in case of failure by the crew to take necessary actions, through optional speed enforcement.

Traditional railway systems require the installation and maintenance of expensive apparatus on the wayside for communicating route availability to approaching trains. The wayside equipment physically displays signals, or aspects, that are interpreted by a crew on board a train approaching the signaling device.

Thus, the interpretation of signal aspects can be subject to human error through confusion, inattention or inclement weather conditions.

An alternative to conventional track circuit-based signaling systems are communication-based train control (CBTC) systems. These train control systems generally include a computer at one or more fixed locations determining the movement authority and/or constraints applicable to each specific train. The computer then transmits this train-specific information in unique messages addressed or directed to each individual train.

SUMMARY OF INVENTION

In one embodiment, a method is provided for controlling movement of a plurality of vehicles over a guideway partitioned into a plurality of guideway blocks. The method uses a control system including an onboard computer (OBC) located on board each vehicle, at least one server for communicating with the OBCs, and a vehicle location tracking system. The method comprises the steps of determining a composite block status for all guideway blocks, broadcasting the composite block status to the OBCs, and controlling movement of each vehicle based on the composite block status.

In another embodiment, a method is provided for controlling movement of a plurality of vehicles over a guideway partitioned into a plurality of guideway blocks. The method uses a control system including an onboard computer (OBC) located on board each vehicle, at least one server for exchanging communication with the OBCs, and a vehicle location tracking system. The method comprises the steps of providing a predetermined mapping data set to each OBC that represents a guideway layout, equivalent block boundaries, and related characteristics of the guideway and utilizing a particular OBC to determine on board a block occupancy for the vehicle including that particular OBC. That particular OBC utilizing the mapping data set.

In a further embodiment, a system is provided for controlling movement of a plurality of vehicles over a guideway partitioned into a plurality of guideway blocks. The system comprising an onboard computer (OBC) located on board each vehicle, at least one server configured to communicate with the OBCs, and a vehicle location tracking system. The system is configured to utilize each vehicle's OBC to determine a block occupancy for that respective vehicle, determines a composite block status based on the block occupancy of each vehicle, transmits the composite block status to each said OBC, and controls movement of the vehicle including a respective said OBC based on the composite block status.

DETAILED DESCRIPTION

Figure 1:
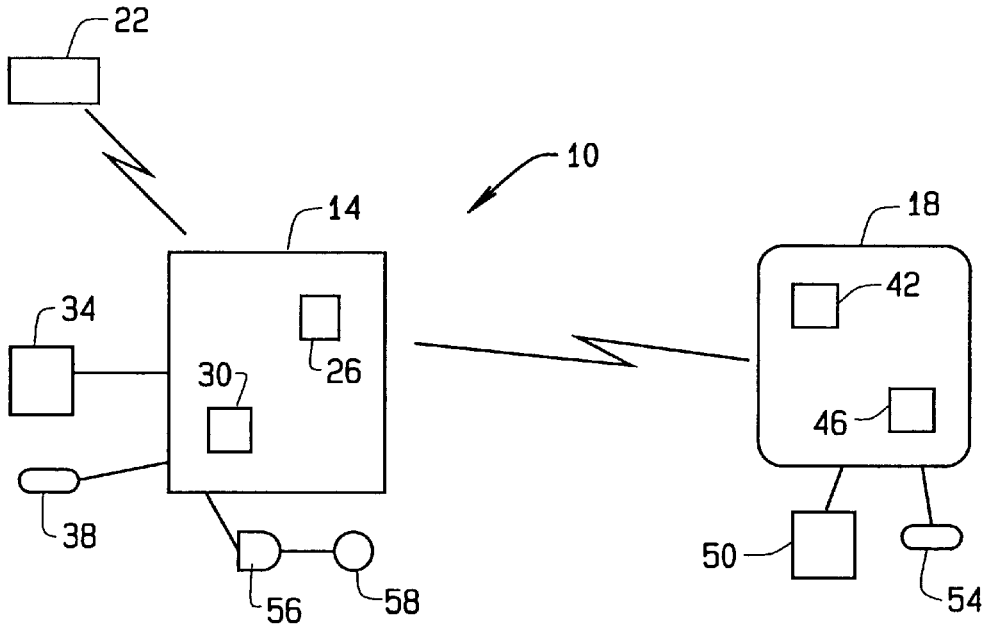
FIG. 1 is a block diagram of a system for controlling the movement of a plurality of vehicles on a guideway in accordance with one embodiment of the present invention.

FIG. 1 is a block diagram of a system 10 for controlling the movement of a plurality of vehicles on a guideway (not shown) in accordance with one embodiment of the present invention. Each vehicle includes one or more vehicular units linked together to form a single vehicle. System 10 includes an onboard computer 14 (OBC) on each vehicle, a server 18 located at a fixed remote site, and an onboard tracking system 22 for tracking the position of each vehicle. OBC 14 includes a processor 26 that performs vital and non-vital calculations as well as vital coding and decoding of information, and a data storage device 30, such as a database. Additionally, OBC 14 is connected to an OBC display 34 for viewing information, data, and possible graphical representations, and an OBC user interface 38 that allows a user to input information, data, and/or queries to OBC 14, for example a keyboard or a mouse. Likewise, server 18 includes a processor 42 that performs vital and non-vital calculations as well as vital coding and decoding of information, and a data storage device 46, which, in one embodiment, includes a database. Furthermore, server 18 is connected to a server display 50 for viewing information, data, and, in one embodiment, graphical representations. Server 18 is also connected to a server user interface 54 that allows a user to input information, data, and/or queries to server 18, for example a keyboard or a mouse.

Both OBC 14 and server 18 interface with various control elements (not shown) such as sensors, actuators, alarms, and wayside devices such as guideway switches, i.e., turnouts, for selecting among two or more diverging routes, signals and occupancy detection circuits, e.g., track circuits. OBC 14 exchanges information with server 18 via a communications system such as a mobile radio network. Tracking system 22 includes position sensors (not shown) and devices (not shown), such as a global positioning system (GPS) receiver, a tachometer, a gyroscope, an odometer, location tags along the guideway and an onboard tag reader. In one embodiment, tracking system 22 is separate from OBC 14 and receives inputs from a least one GPS satellite (not shown). The onboard system may optionally receive and utilize differential correction information to improve location determination accuracy and/or integrity. FIG. 1 shows onboard tracking system 22 separate from OBC 14, however, in another embodiment, OBC 14 includes tracking system 22. In yet another embodiment, tracking system 22 has components that are separate from OBC 14 and components that are included in OBC 22. For example, tracking system 22 components, such as, a global positioning system receiver and software algorithms are included in OBC 14, while other tracking system 22 components, such as, a tachometer, a gyroscope, an odometer, and a guideway tag reader are located separate from OBC 14. In still another embodiment, tracking system 22 receives end of vehicle and front of vehicle information, and inputs from an operator, such as a vehicle engineer, containing information and data relating the position of a vehicle, to determine the location of at least one of the front of the vehicle and the end of the vehicle.

In an alternate embodiment, server 18 is located at a mobile site such as a mobile office structure or a train. In a further embodiment data storage device 30 is not included in OBC 14. Instead data storage device 30 is connected to OBC 14. In addition, data storage device 46 is not included in server 18 but instead is connected to server 18.

In one embodiment, OBC 14 interface with a front of vehicle device 56, which communicates with an end of vehicle device 58 located at the end of the vehicle. Devices 56 and 58 provide vehicle integrity information by detecting possible vehicle separations. In a further embodiment, devices 56 and 58 provide information regarding the length of the vehicle and the location of the end of the vehicle. Alternative potential sources of vehicle length data are external systems (not shown), such as automatic equipment identification (AEI), hot box detectors, axle counters, track circuits, manual entry, and/or information systems.

Figure 2:
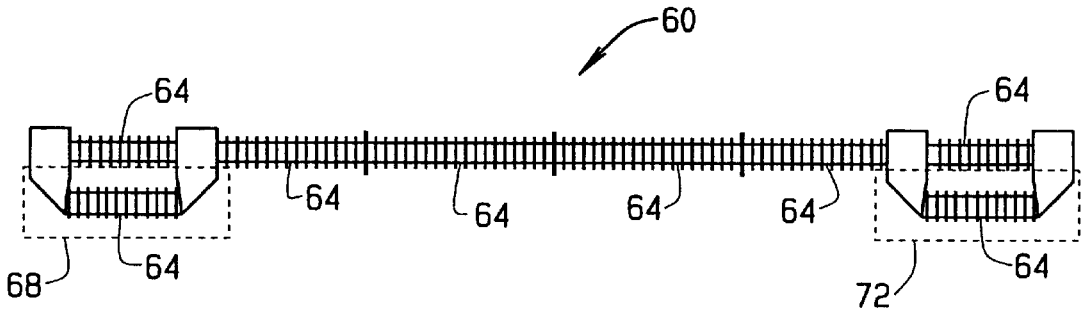
FIG. 2 is diagram of a portion of a guideway, utilized by the system in FIG. 1, partitioned into equivalent blocks.

FIG. 2 is diagram of a portion of a guideway 60 partitioned into equivalent blocks 64. Guideway 60 includes a terrestrial based network (not shown) of guideways that vehicles (not shown) use to move across terrestrial areas of varying size. Server 18 (shown in FIG. 1) contains guideway data, such as equivalent block boundaries and signal logic, that relate to a portion of, or all of, guideway 60. In an alternative embodiment, server 18 contains terrain data relating to guideway 60. In a further embodiment, a traditional signal design algorithm is used to partition guideway 60 into equivalent blocks 64, which represent adjacent sections of guideway 60. The algorithm utilizes information such as, the guideway data, weight of a vehicle, speed of a vehicle, length of a vehicle, and desired traffic capacity to define equivalent blocks 64. The algorithm determines the number and length of equivalent blocks 64 such that the equivalent blocks 64 can be of any number, and of differing lengths. In an alternative embodiment, the block lengths change dynamically as the characteristics of vehicles on a particular section of guideway changes. In one embodiment, the guideway blocks are defined to be small. The small defined blocks, in combination with the use of a braking distance calculation based on actual vehicle and guideway characteristic, allows vehicles to be safely operated with separations approaching the theoretical minimum. A further embodiment permits subdividing of existing conventional physical signaling blocks into smaller sections that are treated as equivalent blocks. This subdividing allows safe reduction of vehicle separation distance in areas where conventional signals driven by guideway circuits, e.g., track circuits, already exist and continue to operate. Additionally, FIG. 2 shows guideway 60 including passing sidings 68 and 72, which are partitioned into equivalent blocks 64.

In one embodiment, server 18 transmits, to each OBC 14, a vitally codified mapping data set containing data related to the characteristics of the guideway. In an alternative embodiment, an off-board source, other than server 18, broadcasts the codified mapping data set to the pertinent OBCs 14. The mapping data set is stored in database 30 and contains information and data such as equivalent block boundaries. In an alternative embodiment, the mapping data set contains related information such as permanent speed restrictions, temporary speed restrictions, grade, and information for interpreting signal aspects. In an alternate embodiment, server 18 transmits a subset of the mapping data set that is specific to a particular section of the guideway or to a particular geographical area. In an alternative embodiment, the mapping data set is predetermined and pre-loaded in database 30. In a further alternative embodiment, locally relevant mapping data is transmitted incrementally as needed from devices in or near the guideway, e.g., tags or distributed servers, so that long term storage and large uploads of mapping data are not required.

Referring now to FIG. 1, as a vehicle progresses along a route, OBC 14 determines the location of the vehicle based on data received from tracking system 22. Using information obtained by tracking system 22, e.g., vehicle length and integrity information as well as the mapping data set, OBC 14 determines which equivalent blocks 64 (shown in FIG. 2) the vehicle is currently occupying. Whenever a vehicle enters a new equivalent block 64, OBC 14 transmits a message to server 18 identifying which equivalent block 64 the vehicle has just entered, and whenever a vehicle leaves an equivalent block 64, OBC 14 transmits a message to server 18 identifying which equivalent block 64 the vehicle has just left. The messages are then stored in database 46.

In another embodiment, OBC 14 predicts and reports any equivalent block 64 that a vehicle will likely occupy before the vehicle can be stopped, for example those equivalent blocks 64 within braking distance of the vehicle. In determining predicted equivalent block occupancies, OBC 14 also applies a margin, increasing the predicted occupancy range to account for factors such as system delays resulting in latency before brakes are applied. The predicted equivalent block occupancies are transmitted to server 18 and stored in database 46Server 18 receives occupancy and clearance information from OBC 14 on board all vehicles utilizing the specific zone of guideway 60 (shown in FIG. 2) monitored by server 18. Additionally, server 18 receives information communicated from wayside devices such as switches or human (manual) input on board. Server 18 uses the reported occupancy and other data to derive an equivalent block status for each equivalent block 64 in a manner similar to that of the logic used in conventional wayside signaling equipment for determining signal aspects from connections with guideway circuits and wayside devices such as switches. The status for each equivalent block 64 is dynamic. The equivalent block status for each block 64 is either limited to one of just two possibilities, corresponding to block occupied or block free, or chosen from multiple possibilities. The multiple possibilities dictate various speed restrictions within equivalent block 64. In the simplest case of just two block status possibilities, a zero or low speed restriction applies in a block that is occupied whereas full speed up to the point of braking distance from the next occupied block entrance is allowed in a block that is not occupied. In alternative embodiments, besides additional levels of speed restriction, additional information is conveyed by the block status indications, such as whether more than one vehicle is in a block, and a diverging route where a vehicle has to turn off of the main line at a turnout.

Server 18 compiles and stores all equivalent block statuses in database 46, then derives a composite equivalent block status containing the equivalent block status information for all equivalent blocks 64 monitored by server 18. Server 18 broadcasts a composite equivalent block status message simultaneously to all vehicles within the zone of server 18 such that each OBC 14 on board every vehicle in the zone of server 18 receives the same information. In one embodiment, server 18 broadcasts composite equivalent block status updates periodically at a predetermined rate. In a further embodiment, server 18 broadcasts the composite equivalent block status updates asynchronously whenever an equivalent block status changes.

In one embodiment, communications between server 18 and OBC 14 utilize a terrestrial based radio network. Each OBC 14 on all the vehicles on the monitored guideway receive radio transmissions of the composite equivalent block status information originating from server 18. In alternative embodiments, communications between server 18 and OBC 14 utilize at least one of cellular and satellite communications.

Figure 3:
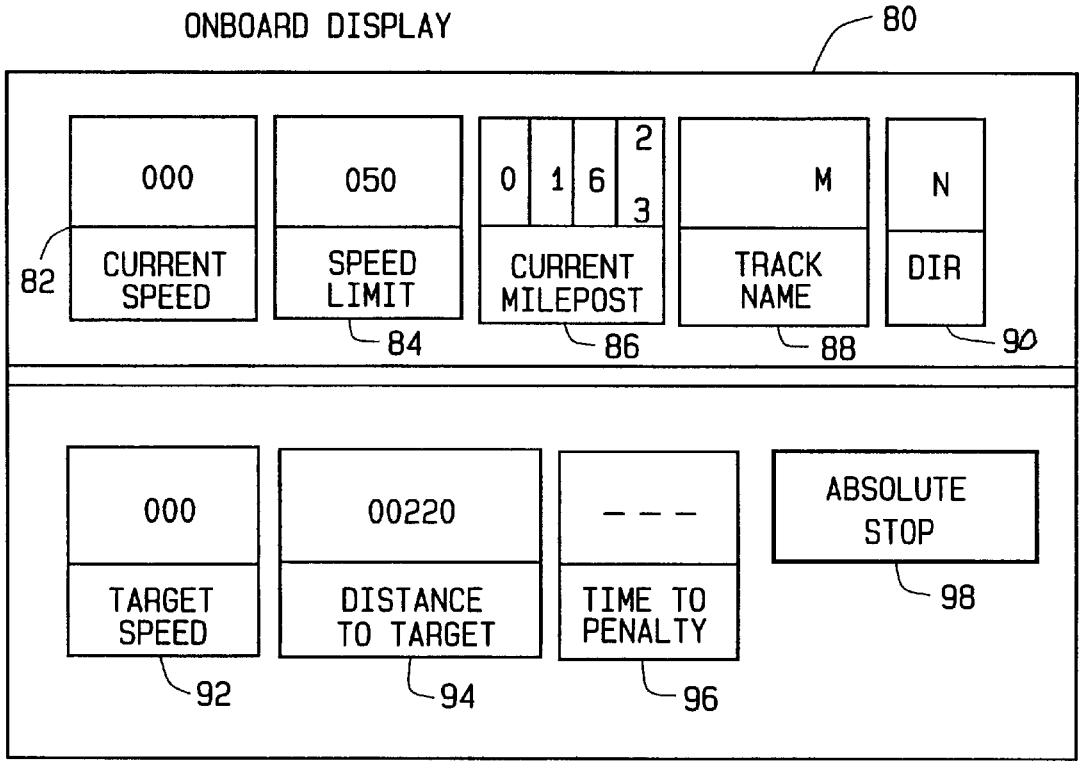
FIG. 3 is an exemplary embodiment of an onboard display of information to a vehicle crew using the system described in FIG. 1.

FIG. 3 is an exemplary embodiment of a graphical representation 80 used to display information related to controlling or restricting the movement of a vehicle. Graphical representation 80 includes a current speed indicator 82, a speed limit indicator 84, a current milepost indicator 86, a track name indicator 88, a direction indicator 90, a target speed indicator 92, a distance to target indicator 94, a time to penalty indicator 96, and an absolute stop indicator 98, which are used to convey vehicle movement controls or restrictions. Based on composite equivalent block status messages received by OBC 14 (shown in FIG. 1), equipment on board each vehicle, such as display 34 (shown in FIG. 1), displays information or restrictions necessary to safely control the vehicle. As shown in graphic 80, information necessary to safely control the vehicle includes information pertinent to that vehicle, a target description, limits on the range of movement allowed for the vehicle, and speed restrictions that may be stored on board. In another embodiment, the display shows signal aspects such as red, yellow and green lights instead of target-based movement constraints. In addition, system 10 (shown in FIG. 1) includes an audible alarm unit (not shown), on board the vehicle, that provides warnings of such things as upcoming targets, limits, signal aspect changes to a more restrictive state or when braking action has been taken.

To react in a safe manner in the event of a communications loss between OBC 14 (shown in FIG. 1) and server 18 (shown in FIG. 1), if more than N, for example N=2, consecutive block status updates are not received by OBC 14, OBC 14 defaults to the most restrictive status for the blocks ahead. Exemplary restrictive statuses for a block include stopping the vehicle, reducing the speed to a low speed, such as about 20 miles per hour (mph) throughout the block, and stopping the vehicle at the entrance to the block and then proceeding at a low speed, such as 20 mph or less.

OBC 14 scans database 30 (shown in FIG. 1) retrieving static information pertaining to targets ahead, such as, speed restrictions, and dynamic data, such as occupied equivalent blocks. The static information designates whether a target is permanent, temporary, or aspect-related. Using the dynamic information in combination with the static information, OBC 14 determines if a lower speed restriction or any other type of target is being approached. OBC 14 then calculates a braking distance based on current speed, target location, and target speed, which may be zero, equating to a stop. In addition, OBC 18 considers guideway gradient and vehicle braking ability to refine the braking distance calculation. OBC 14 determines which target will first require the vehicle to reduce speed or stop.

In a further embodiment, based on the data communications infrastructure and data provided to OBC 14, additional information, such as guideway grade, locations of guideway features, for example crossings, defects detectors, and blocks occupied by other vehicles are displayed in graphic 80 in either graphical or textual format. The additional information is stored in database 30 and used in combination with previously described data to determine modifications in movement of a vehicle and provide information to the crew. The infrastructure also supports the transmission and display of other types of messages, for example bulletins, work orders, and e-mail. In one embodiment, the OBC user interface allows the crew to input information or requests for information that is used on board. In an alternative embodiment, the OBC user interface allows the crew to input information or requests for information to be transmitted off board.

When enforcement braking is used, OBC 14 calculates the distance and time to where braking must start in order to comply with the restrictions associated with each target. If the remaining time for any given target is less than 60 seconds, for example, time to penalty indicator 96 will numerically display the time remaining. If the time remaining is less than one second, for example, and the crew has not taken appropriate action to control the vehicle, the penalty brake will be applied.

Referring again to FIG. 1, in another embodiment, server 18 interfaces with office computers (not shown), for example a dispatching system, to receive information such as requests for routes to be cleared or switch positions to be changed. Additionally, server 18 furnishes information, such as vehicle locations in the form of equivalent block occupancies, to the office computers. Furthermore, server 18 obtains information used in affecting vehicle movements, for example temporary slow orders, guideway data such as grade, permanent speed restrictions, and equivalent signal locations, and vehicle data, such as vehicle length and weight.

In yet another embodiment, system 10 includes a plurality of servers 18 located at one or more locations such as various offices or various wayside locations. Thus, each server 18 is associated with specific equivalent blocks, and receives equivalent block occupancy information only from vehicles occupying the zone of equivalent blocks associated with a specific server 18. Therefore, each server 18 determines a composite equivalent block status unique to the equivalent blocks associated with its zone.

In a further embodiment, OBC 14 uses a conventional onboard cab signal processor (not shown) and an operator interface, such as interface 38. The OBC determines and reports equivalent block occupancies and receives composite equivalent block status information for each equivalent block 64 (shown in FIG. 2). However, OBC 14 synthesizes conventional cab signal codes that are structured like codes from guideway and wayside devices, but are actually communicated to OBC 14 from server 18. The synthesized signal codes are then used to drive the conventional cab signal processor instead of the code signals being detected by conventional cab signal sensors mounted on the vehicle near the guideway.

In yet another embodiment, conventional guideway blocks, as opposed to equivalent blocks, are used to determine block occupancy, block status, and composite block status. Conventional guideway block sizes are determined by physical divisions in the guideway created by conventional guideway occupancy detection circuit equipment.

In a still further embodiment, a pacing function is implemented to further improve railway operational efficiency. Movement planning functionality is incorporated into, or interfaced with, a dispatch system (not shown). The movement planner generates a movement plan for all vehicles within its realm of management with the objective of achieving optimal operations efficiency. The movement plan conforms with the laws of physics as well as safety constraints, such as those imposed by the equivalent block statuses. The movement planner transmits a relevant portion of the movement plan, referred to as a trip plan, to each OBC 14. Trip plans include Estimated Time of Arrival (ETA) and Estimated Time of Departure (ETD) for critical waypoints along the trip. Trip plan messages are sent in addition to, not in lieu of, composite equivalent block status messages. Functionality is added to OBC 14 to generate cues, for example, speed instructions for a vehicle driver which, if followed, control the speed of the vehicle in accordance with the plan. Messages transmitted from each OBC 14 in the form of equivalent block occupancy reports or precise location reports are used by the movement planner to determine if each vehicle is on schedule. If a vehicle falls off schedule to the extent of impacting other vehicles, the movement planner updates the movement plan and transmits a revised trip plan to the affected vehicles.

In another embodiment, a broken guideway detector is mounted on board each vehicle to monitor guideway continuity. Upon detection of a broken guideway, the guideway detector transmits a message to server 18 and notifies the crew who modifies vehicle movement based on the most restrictive aspect for the equivalent block where the break occurred. In an alternative embodiment, the guideway detector transmits a message to server 18 and server 18 notifies the crew. Additionally, notification of detection of a broken rail is transmitted to the OBC's 14 of nearby vehicles in order to inform crews of each vehicle so they may take appropriate action.

In yet another embodiment, system 10 achieves an automatic or driverless vehicle operation. OBC 14 interfaces with a vehicle throttle (not shown), onboard sensors (not shown), and a brake system (not shown) to automatically control vehicle movement in accordance with the controls and restrictions determined by OBC 14. The movement planner function and pacing function are used to direct vehicle movements. The driverless system controls the throttle and brake to conform with the trip plan but will not exceed the safety constraints dictated by the composite equivalent block status message and other restrictions. Alternatively, movement planner and pacing functions are not used to directly control throttle and brake. In this case, the OBC controls vehicle movements based on speed information in the composite block status received from server 18.

The system described above provides a method of achieving railway traffic densities or throughput levels commensurate with or better than those achievable with traditional wayside signaling systems without the use of track circuits or wayside signals. In addition, the cost of deploying, maintaining, and modifying signaling equipment, or equivalent equipment, is reduced.

While the invention has been described in terms of various specific embodiments, those skilled in the art will recognize that the invention can be practiced with modification within the spirit and scope of the claims.

What is claimed:

1. A method for controlling movement of a plurality of vehicles traveling over a guideway that is partitioned into a plurality of guideway blocks spaced along the guideway, using a control system including an onboard computer (OBC) located on board each vehicle, at least one server for communicating with each OBC, and a vehicle location tracking system, said method comprising the steps of:

determining a block occupied status for guideway blocks in advance of the direction of travel of at least one of the vehicles;

broadcasting the block occupied status to the OBC on said one vehicle; and controlling movement of said one vehicle based on the block occupied status for at least the then current stopping distance of said one vehicle regardless of the number of blocks encompassed within the stopping distance.

2. A method in accordance with claim 1 wherein said step of determining a block occupied status comprises the steps of:

providing a predetermined mapping data set to each OBC that represents a guideway layout, block boundaries, and related characteristics of the guideway; and utilizing a particular OBC to determine on board a block occupancy for the vehicle including that particular OBC, that particular OBC utilizing the mapping data set.

3. A method in accordance with claim 2 wherein said step of determining a block occupied status comprises the steps of:

utilizing the server to interpret the block occupancy of each vehicle; and determining a block occupied status for all blocks associated with the server based on the block occupancy of each vehicle utilizing the server.

4. A method in accordance with claim 1 wherein the OBC includes an OBC processor for executing OBC functions, and an OBC data storage device, and the control system further includes an OBC display on board each vehicle for displaying data and information, said step of controlling movement of said one vehicle comprises the steps of:

interpreting the block occupied status to derive at least one of at least one signal aspect, at least one speed target, and at least one movement limit for a specific vehicle using the OBC;

displaying at least one of the signal aspects, speed targets, movement limits, and route on the OBC display of the specific vehicle;

determining a subsequent vehicle movement based on at least one of the signal aspects, speed targets, and movement limits using the OBC; and enforcing the determined subsequent vehicle movement.

5. A method in accordance with claim 1 wherein said step of broadcasting the block occupied status comprises the step of broadcasting the block occupied status over a radio channel from the server to the OBCs such that each OBC on board every vehicle in a particular area receives the same information.

6. A method in accordance with claim 1 wherein said step of controlling movement of said one vehicle comprises the step of constraining the movement of each vehicle based on the most restrictive interpretation of the block occupied status in combination with at least one of temporary speed restrictions, permanent speed restrictions and vehicle-related speed restrictions.

7. A method in accordance with claim 1 further comprising the step of monitoring a position of a guideway switch and including the switch position information as part of the block occupied status.

8. A method in accordance with claim 1 wherein the control system further includes at least one wayside switch and an OBC display on board each vehicle for displaying information and data, said method further comprising the steps of:

monitoring the wayside switch position;

communicating the wayside switch position to the server;

transmitting the wayside switch position to the OBCs; and displaying the wayside switch position on the OBC display.

9. A method in accordance with claim 1 wherein the control system further includes a server data input interface for inputting information and data to the server, said method further comprising the steps of:

inputting at least one wayside switch position to the server using the input interface; and transmitting the wayside switch position to the OBCs.

10. A method in accordance with claim 1 wherein the control system further includes an onboard audible alarm, said step of controlling movement of said one vehicle comprises the steps of using the onboard audible alarm to inform a vehicle crew member of information regarding at least one of signal aspects, speed targets, and movement limits.

11. A method in accordance with claim 1 wherein said step of determining a block occupied status comprises the step of utilizing at least one of a vehicle length, a front of vehicle location, and an end of vehicle location to determine when a block is no longer occupied.

12. A method in accordance with claim 1 wherein the control system further includes at least one of at least one wayside signaling device for producing a wayside signal and at least one wayside guideway circuit for monitoring block occupancy, said step of determining a block occupied status comprises the steps of:

communicating at least one of the wayside signal and a wayside guideway circuit signal to the server; and determining the block occupied status utilizing at least one of the wayside signal and the guideway circuit signal.

13. A method in accordance with claim 1 further comprising:

providing a realizable movement plan for all vehicles over the guideway, the plan including ETAs and ETDs at specified stations based on at least one of guideway parameters, actual vehicle position and velocity data, and guideway condition data; and utilizing the plan to cause the vehicles to operate according to trajectories indicated by the plan.

14. A method in accordance with claim 13 further comprising updating the movement plan in response to at least one of unplanned and deviant movements of vehicles over the guideway.

15. A method in accordance with claim 14 further comprising displaying commands to a vehicle operator on board a vehicle to comply with the movement timeline profile derived from the updated movement plan.

16. A method in accordance with claim 14 further comprising automatically executing at least one of throttle and brake settings for the vehicle in response to the movement plan.

17. A method in accordance with claim 1 further comprising controlling each vehicle's throttle and brakes in accordance with a trip plan sent from a movement planner and in conformance with the block statuses.

18. A method in accordance with claim 1 wherein guideway blocks are subdivisions of physical guideway circuit blocks.

19. A method in accordance with claim 1 further comprising controlling each vehicle's throttle and brakes in accordance with the block occupied status information received from the at least one server.

20. A method in accordance with claim 1 wherein said step of determining a block occupied status comprises the steps of:

providing incrementally a predetermined mapping data set to each OBC that represents a locally relevant portion of the guideway layout, block boundaries, and related characteristics of the guideway;

temporarily storing the increment of mapping data on board;

determining an block occupancy for each vehicle utilizing the mapping data set;

determining an block occupied status for each block based on the block occupancy for each vehicle;

transmitting the block occupied status for each block to each OBC; and controlling movement of each vehicle based on the block occupied status for each block.

21. A method for controlling movement of a plurality of railway vehicles along a length of railway track that is partitioned into a plurality of blocks via the use of a control system that includes a data storage device located on board each vehicle, an onboard computer (OBC) located on board each vehicle, at least one server for communicating with the OBCs, and a vehicle location tracking system, said method comprising the steps of:

storing predetermined track mapping data in the data storage device of at least one railway vehicle, said data being indicative of the track layout and locations of boundaries for each block along the track;

locating the position of at least one railway vehicle along the track by use of its respective on-board tracking system; and determining the respective block occupied by at least one railway vehicle by use of its respective map data.

22. A method in accordance with claim 21 further comprising:

determining a block occupied status for guideway blocks in advance of the direction of travel of at least one railway vehicle;

transmitting the block occupied status to the OBC on said one vehicle; and controlling movement of said one vehicle based on the block occupied status for at least the then current stopping distance of said one vehicle regardless of the number of blocks encompassed within the stopping distance.

23. A method in accordance with claim 21 wherein each OBC includes an OBC processor for executing OBC functions, said step of storing predetermined track mapping data comprises the steps of:

communicating the mapping data from the server to each OBC; and storing the mapping data in the data storage device.

24. A method in accordance with claim 21 wherein each OBC includes an OBC processor for executing OBC functions, said step of storing predetermined mapping data comprises the step of pre-installing the predetermined mapping data in the data storage device.

25. A method in accordance with claim 21 wherein the vehicle location tracking system includes at least one of a global position system (GPS), an odometer, a gyroscope, and a set of railway location tags, said step of determining the respective block occupied by at least one railway vehicle comprises the steps of:

determining a location of each vehicle using the OBC, and the location tracking system;

comparing the location of each vehicle to the predetermined mapping data set utilizing the OBC; and determining the block occupancy for each vehicle based on the comparison utilizing the OBC.

26. A method in accordance with claim 25 wherein the control system further includes at least one control element and the OBCs interface with the control element, said step of determining a location comprises the steps of:

collecting location tracking data for each vehicle utilizing at least one of the GPS, the odometer, the gyroscope and the location tags;

determining a front of vehicle location and an end of vehicle location;

collecting location tracking data for each vehicle utilizing the control element; and communicating the location tracking data to the OBC.

27. A method in accordance with claim 25 wherein the OBC utilizes at least one of train length and end of train location information received from at least one of a source at an end of the train and an external source, said method further comprising the step of determining when the train has cleared a block.

28. A method in accordance with claim 21 further comprising the step of utilizing characteristics obtained from physical wayside signals to determine block status.

29. A method in accordance with claim 21 further comprising the step of utilizing occupancy status obtained from physical wayside sensors to determine block status.

30. A method in accordance with claim 25 wherein the server includes a processor for executing server functions and a server data storage device, said step of determining the respective block occupied by at least one railway vehicle further comprises the steps of:

communicating the respective block occupied by each vehicle from each respective OBC to the server; and storing the block occupancy for each vehicle in the server data storage device.

31. A method in accordance with claim 21 wherein the control system further includes at least one of at least one guideway break detection unit on board each vehicle and at least one wayside guideway break detection unit, the onboard break detection unit communicates with the OBC, the wayside break detection unit communicates with the server, said step of determining the respective block occupied by at least one railway vehicle further comprises the steps of:

detecting a break in the guideway utilizing at least one of the onboard break detection unit and the wayside break detection unit;

communicating detection of a guideway break to the server; and utilizing detection of a guideway break to determine at least one block occupied status.

32. A method in accordance with claim 22 wherein the OBC includes an OBC processor for executing OBC functions, and the control system further includes an OBC display on board each vehicle for displaying data and information, said step of controlling movement of said one vehicle comprises the steps of:

interpreting the block occupied status to derive at least one of at least one signal aspect, at least one speed target, and at least one movement limit for a specific vehicle using the OBC;

displaying the at least one signal aspect, speed target, and movement limit on the OBC display of the specific vehicle;

determining a subsequent vehicle movement based on at least one of signal aspect, speed target, and movement limit using the OBC; and enforcing the determined subsequent vehicle movement.

33. A method in accordance with claim 22 wherein said step of transmitting the block occupied status comprises the step of broadcasting the block occupied status from the server to each OBC such that each OBC on board every vehicle in a particular area receives the same information.

34. A method in accordance with claim 21 wherein the at least one server includes a plurality of servers, each server associated with specific guideway blocks and including a server data storage device, said step of determining the respective block occupied by at least one railway vehicle comprising the steps of:

communicating the block occupancy of each vehicle to the server associated with the respective guideway block;

storing the block occupancy in the server data storage device;

determining an block status for each block based on the block occupancy of all vehicles utilizing the associated server; and utilizing each server to translate the block statuses of all blocks associated with each server into a plurality of unique composite block statuses.

35. A method in accordance with claim 1 wherein at least one vehicle is a train.

36. A method in accordance with claim 1 wherein determining a block occupies status comprises determining a block occupied status for all guideway blocks along the guideway.

37. A method in accordance with claim 1 wherein controlling movement of said one vehicle comprises controlling movement of each vehicle based on a block occupied status for all guideway blocks.

38. A method in accordance with claim 21 wherein storing predetermined track mapping data in the data storage device of at least one railway vehicle comprises storing predetermined track mapping data in the data storage device of each railway vehicle.

39. A method in accordance with claim 21 wherein determining the respective block occupied by at least one railway vehicle by use of its respective map data comprises determining the respective block occupied by each railway vehicle by use of its respective map data.

40. A method in accordance with claim 21 wherein the control system further includes a wireless receiver on board each vehicle, said method further comprising receiving at each railway vehicle data regarding the blocks occupied by the other vehicles on the track by use of the wireless receiver on the respective vehicles.

41. A method in accordance with claim 40 further comprising:

controlling travel of each vehicle based on its respective vehicle braking profile.

42. A method in accordance with claim 41 further comprising:

calculating a vehicle braking profile for the safe travel of each vehicle along the track by use of the respective map data and the blocks occupied by the other vehicles on the track.

43. The method of claim 21 wherein the control system further comprises at least one piece of wayside equipment along the track that affects the status of blocks along the track for the travel of vehicles in the blocks, and the method further comprising:

receiving at each railway vehicle data regarding the status of all of the blocks affected by wayside equipment along the track; and calculating a vehicle braking profile for each vehicle for safe travel of said vehicle by use of the map data on the respective vehicle, the data regarding the blocks occupied by the other vehicles, and the data regarding the status of the blocks affected by the wayside equipment.

44. The method of claim 21 further comprising controlling the operation of at least one of said vehicles by activating alarms for directing operators on the vehicles.

45. The method of claim 21 wherein each of said vehicles has a throttle system and a braking system and said method further comprises controlling the operation of at least one of said vehicles by automated control of the throttle and braking systems of said vehicle.

46. The method of claim 43 wherein the wayside equipment includes a point switch mechanism at the intersection of two diverging tracks with the status of the block affected by the switch being indicative of the track with which the switch is aligned, and said receiving of data regarding the status of all of the blocks affected by wayside equipment includes receiving data indicative of the track with which the switch is aligned.

47. The method of claim 21 further comprising providing data relating to local travel restrictions for at least one railway vehicle for the track located within the then current stopping distance of said vehicle, and controlling the operation of said vehicle based at least in part on the local travel restriction data.

48. The method of claim 21 further comprising providing a movement plan for said plurality of vehicles, with the plan including estimated times of arrival and estimated times of departure for the vehicles at points along the track, and controlling the operation of the vehicles based at least in part on the movement plan.

49. A method of controlling movement of a plurality of railway vehicles along a length of railway track that is partitioned into a plurality of blocks via the use of a control system that includes a computer, a tracking system and a wireless receiver on board each vehicle, the method comprising:

locating the position of each railway vehicle along the track by use of its respective on-board tracking system;

determining the respective block occupied by each railway vehicle by use of its respective on-board computer;

receiving at each railway vehicle data regarding the blocks occupied by all of the other railway vehicles on the track by use of the wireless receiver on the respective vehicle; and controlling the operation of each vehicle by use of the on-board computer and the data regarding the blocks occupied by the other railway vehicles.

50. A method in accordance with claim 49 further comprising:

calculating a vehicle braking profile for each vehicle for the safe travel of said vehicle, at least for its then current stopping distance regardless of the number of blocks encompassed within the stopping distance, by use of the on-board computer of the respective vehicle and the data regarding the blocks occupied by the other railway vehicles; and controlling the operation of each vehicle based on its respective vehicle braking profile.

51. The method of claim 49 wherein the control system further comprises at least one piece of wayside equipment along the track that affects the status of blocks along the track for the travel of vehicles in the blocks, and the method further comprising:

receiving at each railway vehicle data regarding the status of all of the blocks affected by wayside equipment along the track; and calculating a vehicle braking profile for each vehicle for safe travel of said vehicle, at least for its then current stopping distance regardless of the number of blocks encompassed within the stopping distance, by use of the on-board computer of the respective vehicle, the data regarding the blocks occupied by the other vehicles and the data regarding the status of the blocks affected the wayside equipment.

52. The method of claim 51 wherein said calculating a vehicle braking profile comprises calculating the braking profile for each vehicle for safe travel of said vehicle from its then present location on the track to the adjacent boundary of the closet block occupied by the other rail vehicles or having a status making the block unavailable for travel by the vehicle.

53. The method of claim 49 further comprising calculating signal aspects for at least one of said vehicles for the safe travel of said vehicle by use of the on-board computer of said vehicle and the data regarding the blocks occupied by the other railway vehicles.

54. The method of claim 49 further comprising calculating speed targets for at least one of said vehicles for the safe travel of said vehicle by use of the on-board computer of said vehicle and. the data regarding the blocks occupied by the other railway vehicles.

55. The method of claim 49 further comprising calculating movement limits for at least one of said vehicles for the safe travel of said vehicle by use of the on-board computer of said vehicle and the data regarding the blocks occupied by the other railway vehicles.

56. The method of claim 49 further comprising controlling the operation of at least one of said vehicles by activating alarms for operators on the vehicles.

57. The method of claim 49 wherein each of said vehicles has a throttle system and a braking system, and said method further comprises controlling the operation of at least one of said vehicles by automated control of the throttle and braking systems of said vehicle.

58. The method of claim 49 wherein each of said vehicles has a front and an end spaced from the front, and said method further comprises locating the positions of the front and the end of each vehicle and determining the respective block occupied by the front of the vehicle and the respective block occupied by the end of the vehicle.

59. The method of claim 57 wherein the wayside equipment includes a point switch mechanism at the intersection of two diverging tracks with the status of the block affected by the switch being indicative of the track with which the switch is aligned, and said receiving of data regarding the status of all of the blocks affected by wayside equipment includes receiving data indicative of the track with which the switch is aligned.

60. The method of claim 49 further comprising providing data relating to local travel restrictions for at least one railway vehicle for at least the track located within the then current stopping distance of said vehicle, and controlling the operation of said vehicle based at least in part on the local travel restriction data.

61. The method of claim 49 further comprising providing a movement plan for said plurality of vehicles, with the plan including estimated times of arrival and estimated times of departure for the vehicles at points along the track, and controlling the operation of the vehicles based at least in part on the movement plan.

62. A method of controlling movement of a plurality of railway vehicles along a length of railway track that is partitioned into a plurality of blocks via the use of a control system that includes a wireless receiver and a wireless transmitter on board each vehicle, a server off-board of the vehicles, and a communication system off-board of the vehicles in communication with the vehicles and the server, said method comprising:

locating the position of each railway vehicle along the track by use of its respective tracking system;

determining the respective blocks occupied by each railway vehicle;

transmitting data indicative of the blocks occupied by each of the railway vehicles to the server at timed intervals by use of the communication system;

determining the block occupancy of all of the railway vehicles on the track, at the server based on the block occupied by each railway vehicle;

broadcasting data indicative of the blocks occupied by all of the railway vehicles from the server to all railway vehicles on the track at timed intervals; and controlling the operation of each vehicle by use the data indicative of the blocks occupied by all of the railway vehicles.

63. The method of claim 62 further comprising:

calculating a vehicle braking profile for the safe travel of each vehicle along the track by use of the data indicative of the blocks occupied by the other railway vehicles; and controlling operation of each vehicle based on its respective vehicle braking profile.

64. The method of claim 62 wherein the control system further comprises at least one piece of wayside equipment along the track that affects the status of blocks along the track for the travel of vehicles in the blocks and a transmitter communicating the status of the block associated with the wayside equipment, and the method further comprising:

transmitting the status of a block affected by each piece of wayside equipment to the server;

broadcasting data indicative of the status of all blocks affected by wayside equipment along the track; and calculating a vehicle braking profile for each vehicle for safe travel of said vehicle by use of the data indicative of the block occupied by the vehicles and the data indicative of the status of the blocks affected by the wayside equipment.

65. The method of claim 62 further comprising calculating signal aspects for at least one of said vehicles for the safe travel of said vehicle by use of the data regarding the blocks occupied by the other railway vehicles.

66. The method of claim 62 further comprising calculating speed targets for at least one of said vehicles for the safe travel of said vehicle by use of the data regarding the blocks occupied by the other railway vehicle.

67. The method of claim 62 further comprising calculating movement limits for at least one of said vehicles for the safe travel of said vehicle by use of the data regarding the blocks occupied by the other railway vehicles.

68. The method of claim 62 further comprising controlling the operation of at least one of said vehicles by activating alarms for operators on the vehicles.

69. The method of claim 62 wherein each of said vehicles has a throttle system and a braking system, and said method further comprises controlling the operation of at least one of said vehicles by automated control of the throttle and braking systems of said vehicle.

70. The method of claim 62 wherein each of said vehicles has a front and an end spaced from the front, and said method further comprises locating the positions of the front and the end of each vehicle and determining the respective blocks occupied by the front of the vehicle and the respective block occupied by the end of the vehicle.

71. The method of claim 64 wherein the wayside equipment includes a point switch mechanism at the intersection of two diverging tracks with the status of the block affected by the switch being indicative of the track with which the switch is aligned, and said receiving of data regarding the status of all of the blocks affected by wayside equipment includes receiving data indicative of the track with which the switch is aligned.

72. The method of claim 62 further comprising providing data relating to local travel restrictions for at least one railway vehicle for at least the track located within the then current stopping distance of said vehicle and controlling the operation of said vehicle based at least in part on the local travel restriction data.

73. The method of claim 62 further comprising providing a movement plan for said plurality of vehicles, with the plan including estimated times of axial and estimated times of departure for the vehicles at points along the track, and controlling the operation of the vehicles based at least in part on the movement plan.

74. A method for controlling movement of a plurality of vehicles traveling over a guideway that is partitioned into a plurality of guideway blocks spaced along the guideway, using a control system including an onboard computer (OBC) located on board each vehicle, at least one server for communicating with each OBC, and a vehicle location tracking system, said method comprising:

determining a block occupancy for at least one vehicle; and controlling movement of the at least one vehicle using the onboard computer based on the determined block occupancy and a block status for guideway blocks in advance of the direction of travel of the at least one vehicle.

75. A method in accordance with claim 74 further comprising controlling movement of the at least one vehicle using the onboard computer based on the determined block occupancy and a block status for all guideway blocks.

76. A method in accordance with claim 74 wherein the at least one vehicle is a train.

* * * * *

UNITED STATES PATENT AND TRADEMARK OFFICE

CERTIFICATE OF CORRECTION

PATENT NO. : 6,459,965 B1
DATED : October 1, 2002
INVENTOR(S) : Polivka et al.

It is certified that error appears in the above-identified patent and that said Letters Patent is hereby corrected as shown below:

Column 12,
Line 65, delete “occupies” and insert therefor -- occupied --.

Column 15,
Line 18, delete “57” and insert therefor -- 51 --.

Column 16,
Line 64, delete “axial” and insert therefor -- arrival --.

Signed and Sealed this

Third Day of May, 2005

JON W. DUDAS
*Director of the United States Patent and Trademark Office*